US005974596A

United States Patent [19]

Strzok

[11] Patent Number: 5,974,596

[45] Date of Patent: Nov. 2, 1999

[54] HIGH PRESSURE PLUNGER DEVICE

[76] Inventor: Michael Jerome Strzok, 15708 Wilson Creek Rd., Lawrenceburg, Ind. 47025

[21] Appl. No.: 08/964,806

[22] Filed: Nov. 5, 1997

[51] Int. Cl.[6] ..... E03D 9/00

[52] U.S. Cl. ..... 4/255.11; 4/255.12

[58] Field of Search ..... 4/255.01–255.12; 15/104.05

[56] References Cited

U.S. PATENT DOCUMENTS

| | | | |
|---|---|---|---|
| 729,156 | 5/1903 | Geiger | 4/255.03 |
| 1,673,447 | 6/1928 | Fielder | 4/255.11 |
| 1,972,114 | 9/1934 | Stephenson | 4/255.12 |
| 2,066,773 | 1/1937 | Felice | 4/255.11 |
| 2,406,317 | 8/1946 | Bonde | 4/255.11 |
| 2,496,525 | 2/1950 | Eggleston | 4/255.12 |
| 2,846,698 | 8/1958 | Tomlinson | 4/225.11 |
| 3,062,152 | 11/1962 | Huff, Sr. | 4/255.01 |
| 3,644,943 | 2/1972 | Leonardo et al. | 4/255.11 |
| 4,847,923 | 7/1989 | Huang | 4/255.03 |

*Primary Examiner*—Charles R. Eloshway
*Attorney, Agent, or Firm*—Carl E. Knochelmann, Jr.

[57] ABSTRACT

An improved hand operated plunger for clearing drains and other plumbing fixtures of obstructions is disclosed. The hand operated plunger has two coaxial handles that help maintain a seal with the plumbing fixture during operation and check valves that direct hydraulic or pneumatic pressure to the obstruction through the application of hand force applied to the movable handle. In the event that one stroke of the handle does not dislodge the obstruction, a second or subsequent stroke may be applied without loosing all of the pressure developed from the first stroke. In one preferred embodiment, air is used to create pneumatic pressure that is applied to the obstruction through check valves and the pressure is increased by subsequent strokes of the movable plunger handle. In an alternate embodiment, liquid, such as water, is used to create hydraulic pressure that is applied to the obstruction through check valves and the pressure developed is directly related to the force applied to the movable plunger handle.

6 Claims, 8 Drawing Sheets

HIGH PRESSURE PLUNGER DEVICE

FIELD OF THE INVENTION

This invention relates, in general, to plumbing devices used for clearing clogged drains and more particularly to hand operated plumbing devices that apply hydraulic or pneumatic pressure to drainage obstructions in pipes and plumbing fixtures.

DESCRIPTION OF THE PRIOR ART

A conventional hand operated plunger employs a resilient flexible cup attached to a handle that is located over the clogged drain creating a seal. The handle is depressed causing the cup to collapse thereby applying pressure to the obstruction in the drain. Repeated depression of the handle generates pulses of pressure that often times fail to dislodge the obstruction in the drain.

Hand operated plungers of the prior art frequently have the disadvantage of being unable to apply sufficient pressure to dislodge the obstruction. On the up stroke of the depressed handle, the pressure originally applied to the obstruction is reversed as the cup regains its original shape.

The conventional hand operated plunger has been modified to improve the pumping action. For example, U.S. Pat. No. 4,622,702 (Allen) teaches the use of a check valve that minimizes the reverse pressure on the up stroke of the handle. However, this improvement to the prior art has the limitation that the pressure applied to the obstruction is limited to the maximum pressure that can be contained by the seal between the drain and the plunger cup as the handle is depressed. The improved prior art plunger is operated with one hand and the force applied to the handle to depress the cup is the same force used to create the seal between the drain and the plunger cup. When the maximum seal pressure is exceeded, in all prior art plungers, the pressure is released into the surrounding liquid often times causing the liquid to be splashed or sprayed outside of the plumbing fixture and sometimes on the plunger operator which is undesirable.

In spite of the fact that many attempts to improve the conventional hand plunger have been made, there remains a need for a hand operated plunger that can apply a higher hydraulic or pneumatic pressure to an obstruction in a drain without the deficiencies of the prior art that is simple to operate, is effective and is inexpensive.

SUMMARY OF THE INVENTION

In carrying out this invention in one form thereof, a high pressure plunger that is operated by hand is provided. The plunger includes an inner cavity formed by a resiliently compressible first cup and an end member, outer cavity formed by a rigid second cup and the end member, a first handle connected to the first cup, a second handle connected to the second cup and a means for pressurizing an external fixture. The second cup is larger than and concentric with the first cup. The first handle is coaxial with and slidably engages the second handle. A first check valve is located in the first cup and a second check valve is located in the end member. A check valve permits fluid flow in only one direction and can be of any one of several conventional designs such as a butterfly valve or a ball check valve. The pressurizing means comprises configuring the first check valve to permit fluid flow into the inner cavity; configuring the second check valve to permit fluid flow from the inner cavity to the external fixture, such as a drain in a sink or a toilet, that has an obstruction; creating a seal between the external fixture and the end member by holding the end member in contact with the external fixture by a force applied to the second handle; compressing the first cup by moving the first handle from a start position toward the end member and providing a means to supply air to the outer cavity. Air is supplied to the outer cavity through space between the first handle and the second handle or by a vent in the second cup. The fluid flow into the inner cavity comprises air from the outer cavity or liquid from outside the second cup. The liquid from outside the second cup typically comprises water from an external source, such as a bucket, or water and other matter found suspended in the liquid backed up in the obstructed plumbing fixture. The first cup and the end member may include a plurality of check valves as a particular application may dictate wherein all valves in each location would be aligned to permit fluid flow in the same direction. The first cup is comprised of rubber or other water tolerant and resiliently compressible material and the second cup is comprised of any water tolerant rigid material such as some type of rubber, fiberglass, aluminum or a combination thereof.

BRIEF DESCRIPTION OF THE DRAWINGS

A more complete understanding of the invention may be had by reference to the accompanying drawings in which.

DESCRIPTION OF THE PREFERRED EMBODIMENTS

Figure 1:
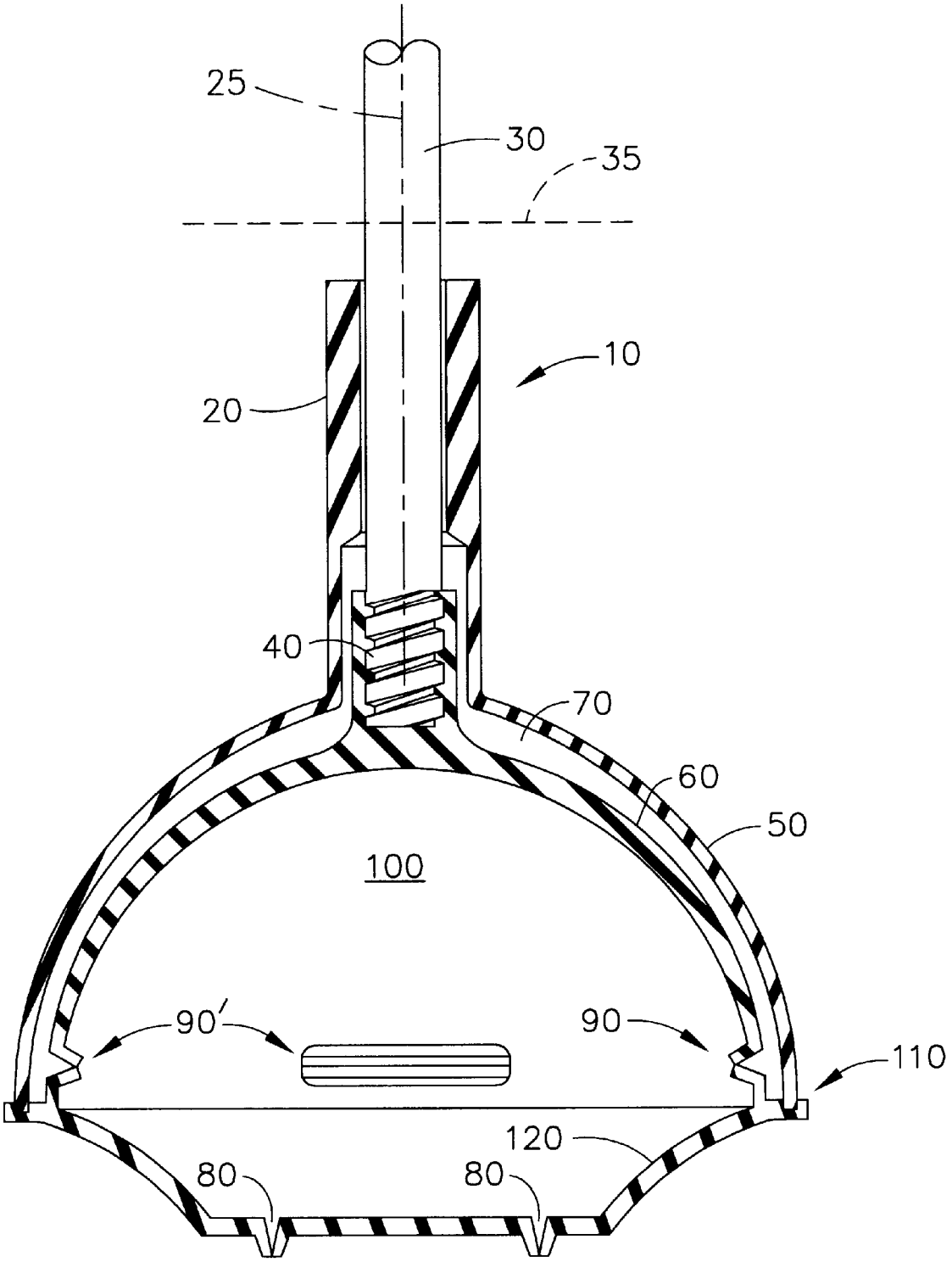
FIG. 1 illustrates a cross sectional view of a high pressure plunger that pumps air and the first handle is shown at a start position.

Referring now to the Figures wherein like referenced numerals have been used throughout to designate like parts, FIG. 1 is a cross sectional view of a high pressure plunger 10, sectioned through its axis of rotation 25, with an elongated first handle 30 situated at a start position 35. First handle 30 is connected to a resiliently compressible first cup 60 at handle connection 40. Handle connection 40 is depicted as a screw connection, however other connections such as a compression connection may be utilized. First cup 60 forms inner cavity 100 by its connection with end member 120 at joint 110. An elongated second handle 20 is connected to a second cup 50 and is coaxial with and slidably engaged by first handle 30. Second cup 50 is rigid and forms outer cavity 70 with first cup 60 by its connection with end member 120 also at joint 110. First cup 60 and second cup 50 are concentric with first cup 60 being smaller than and enclosed by second cup 50.

A first check valve 90, that may comprise one or more elements, provides unidirectional air flow into inner cavity 100 from outer cavity 70. A second check valve 80, that may comprise one or more elements, provides unidirectional air flow out of inner cavity 100 when first cup 60 is compressed by the movement of first handle 30 toward end member 120.

Figure 2:
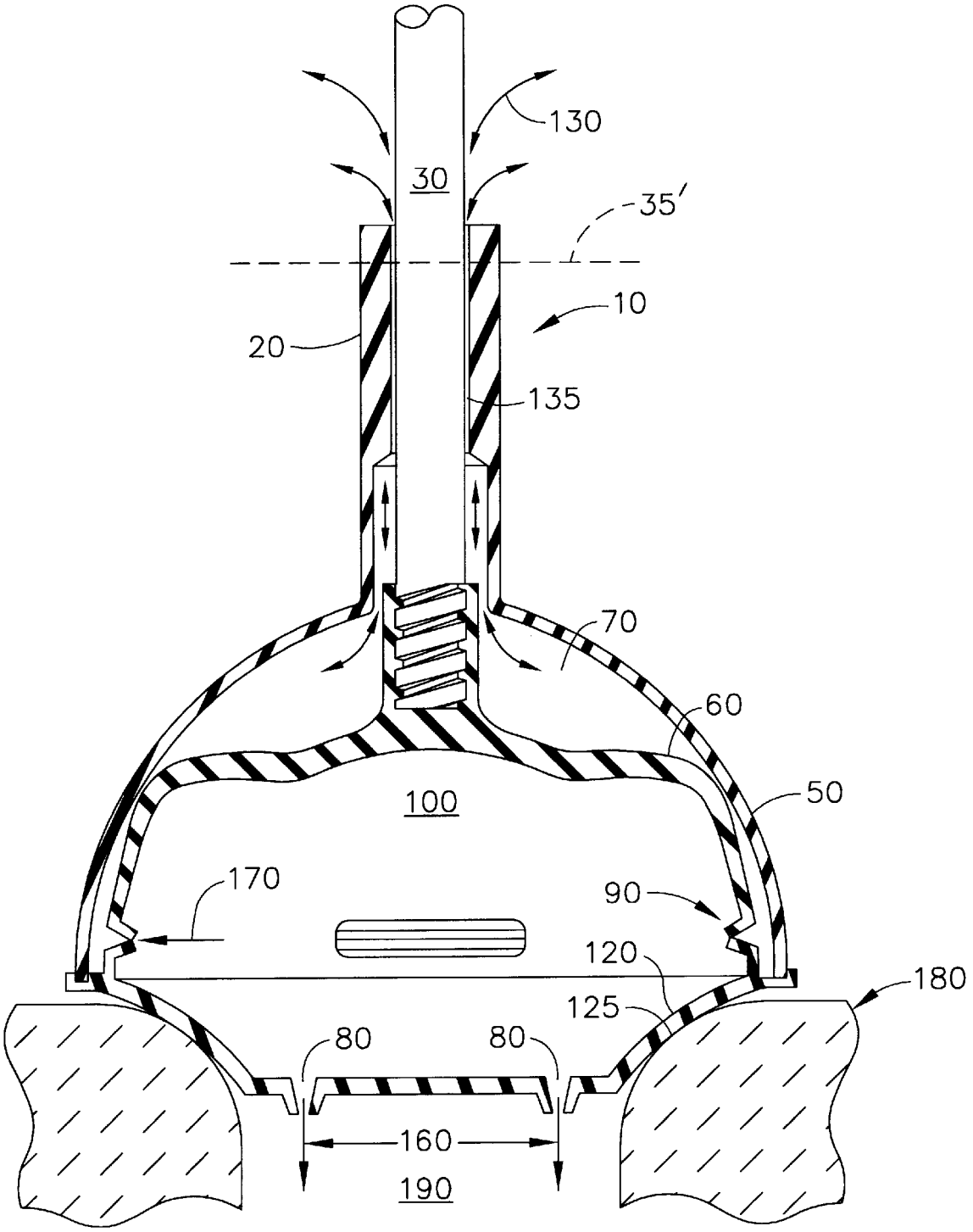
FIG. 2 illustrates a cross sectional view of the high pressure plunger of FIG. 1 engaged with a plumbing fixture and the first handle is partially depressed.

FIG. 2 is a cross sectional view of the air operated high pressure plunger 10 of FIG. 1 engaged with a plumbing fixture 180. High pressure plunger 10 creates a seal 125 with plumbing fixture 180. Seal 125 is created and maintained by external force (not shown) applied through second handle 20 and second cup 50 toward plumbing fixture 180. End member 120 is structurally rigid with a resilient surface that conforms to any irregularities or roughness in the surface of plumbing fixture 180 when the external force is applied. After applying and maintaining external force with one hand to second handle 20, first handle 30 is moved from start position 35, shown in FIG. 1, to an intermediate position 35' with a second hand. As first handle 30 is moved, toward end member 120, first cup 60 is compressed which increases air pressure inside inner cavity 100. The higher air pressure in inner cavity 100 maintains first check valves 90 in a closed position, as shown at 170, and opens second check valve 80, as shown at 160. As first handle 30 is moved further toward end member 120, higher air pressure is created in inner cavity 100 and causes air flow from inner cavity 100 into plumbing fixtures cavity 190. Air pressure in outer cavity 70 is decreased causing air flow 130 to enter through space 135.

Seal 125 is maintained throughout operation by said external force on second handle 20. The increased air pressure in plumbing fixture cavity 190 is intended to dislodge any obstruction (not shown) located distally from said end member 120.

Figure 3:
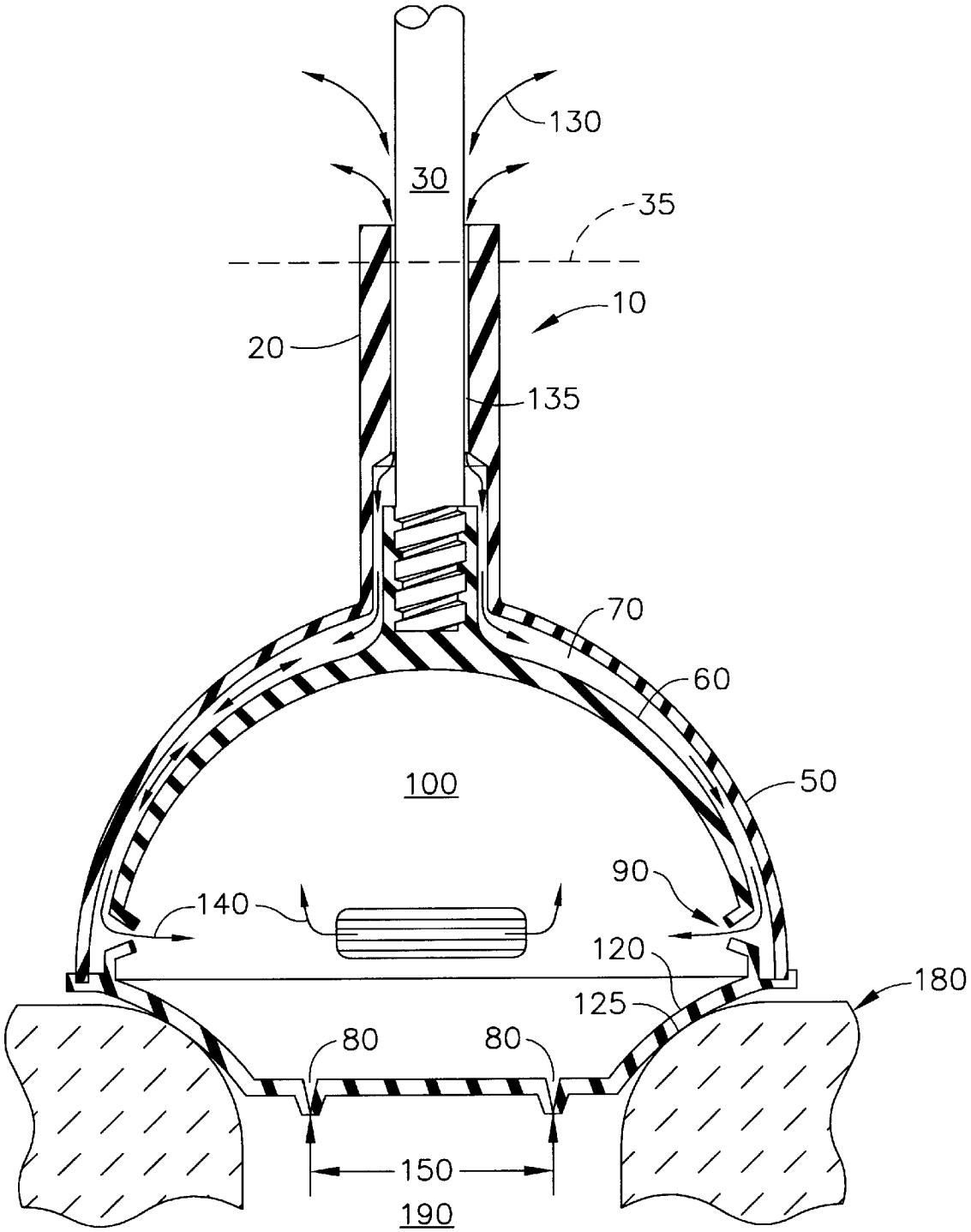
FIG. 3 illustrates a cross sectional view of the high pressure plunger of FIG. 1 engaged with a plumbing fixture and the first handle has been nearly retracted to the start position.

In the event said obstruction (not shown) is not dislodged by increased air pressure created cavity 190, first handle 30 may be retracted as illustrated in FIG. 3 in preparation for one or more subsequent strokes of the first handle 30. Seal 125 is maintained by continuing external force applied through second handle 20 while first handle 30 is retracted.

Referring again to FIG. 3, high pressure plunger 10 is nearly retracted to start position 35. As first handle 30 begins to retract, air pressure in inner cavity 100 is decreased below that of plumbing fixture cavity 190 which closes check valve 80, as shown at 150, and first check valves 90 in first cup 60 to opens as shown at 140. As first handle 30 is retracted farther, air in outer cavity 70 is drawn into inner cavity 100 and from an external area as shown at 130 through handle space 135 situated between first handle 30 and second handle 20. When first handle 30 is returned to its start position 35 (as shown in FIG. 1) air flow stops and first check valves 90 and second check valves 80 are both closed as shown in FIG. 1.

The procedure of applying a second or subsequent stroke of first handle 30 would proceed as described herein for the first stroke and illustrated in FIG. 2 and FIG. 3. It is anticipated that multiple strokes of first handle 30 could be made while maintaining seal 125 between end member 120 and plumbing fixture 180 with continuous external force on second handle 20 and second cup 50. The effect of each subsequent stroke would be to further increase air pressure in plumbing fixture cavity 190 until said obstruction (not shown) is dislodged.

Figure 4:
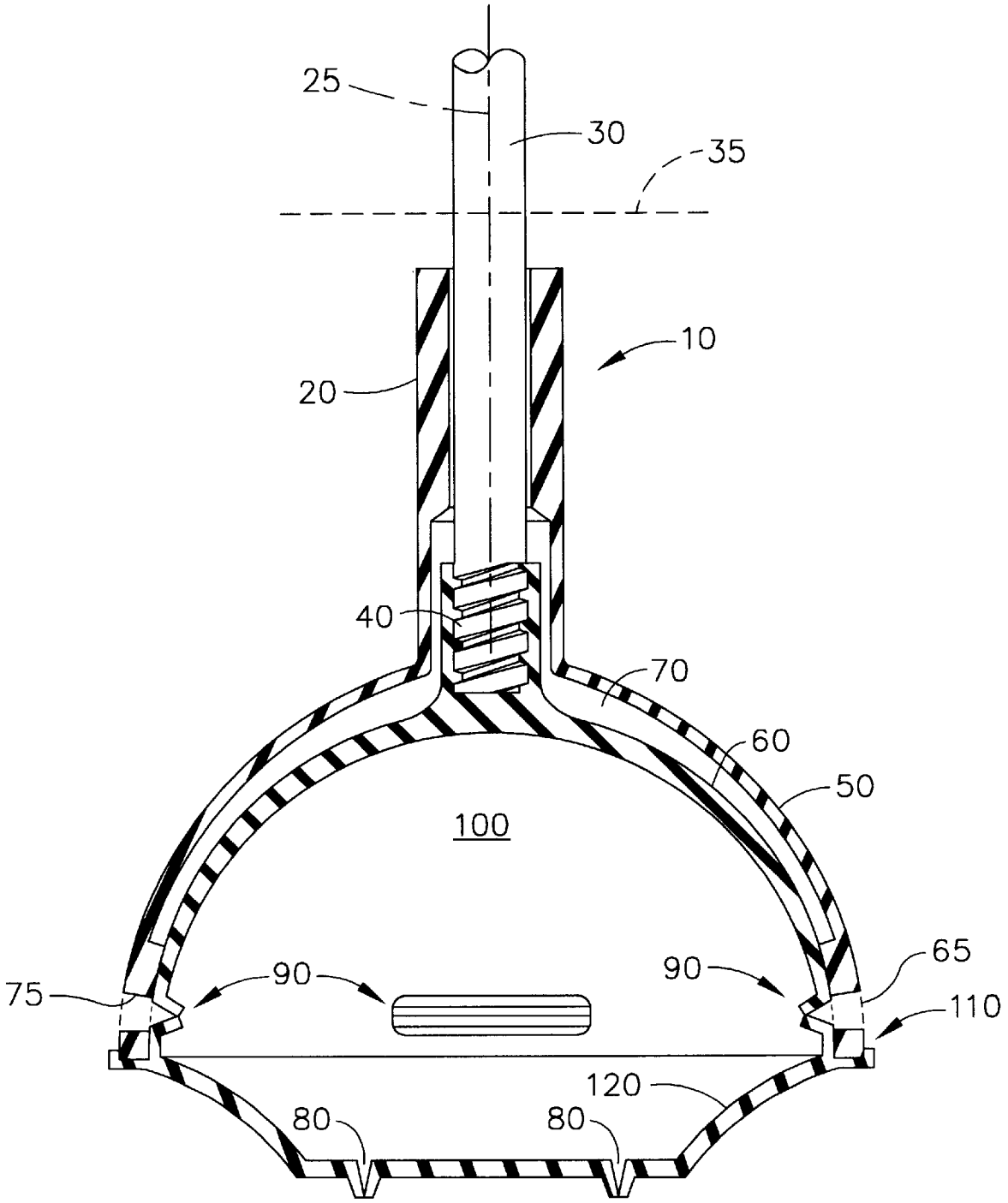
FIG. 4 illustrates a cross sectional view of a high pressure plunger that pumps liquid and the first handle is shown at a start position.

An alternate embodiment of the present invention is a liquid operated high pressure plunger 10, as illustrated in FIG. 4, sectioned through its axis of rotation 25. The functional operation of liquid operated high pressure plunger 10 of FIG. 4 is similar to the operation of air operated high pressure plunger 10 described above and illustrated in FIGS. 1, 2, and 3. An elongated first handle 30, situated at start position 35, is connected to resiliently compressible first cup 60 at handle connection 40. Handle connection 40 is depicted as a screw connection, however other connections such as a compression connection may be utilized. First cup 60 forms inner cavity 100 by its connection with end member 120 at joint 110. An elongated second handle 20 is connected to a second cup 50 and is coaxial with and is slidably engaged by first handle 30. Second cup 50 is ridged and forms outer cavity 70 with first cup 60 by its connection with end member 120 also at joint 110. First cup 60 and second cup 50 are concentric with first cup 60 being smaller than and enclosed by second cup 50.

A first check valve 90 that may comprise one or more elements, provides unidirectional liquid flow into inner cavity 100 from a liquid source (not shown) outside second cup 50. Screen 65 prevents solid matter from entering inner cavity 100. The liquid source comprises either a clean water supply from a container, such as a bucket, or liquid backed up in a plumbing fixture by an obstruction. A second check valve 80, that may comprise one or more elements, provides unidirectional liquid flow out of inner cavity 100 when first cup 60 is compressed by the movement of first handle 30 toward end member 120.

Figure 5:
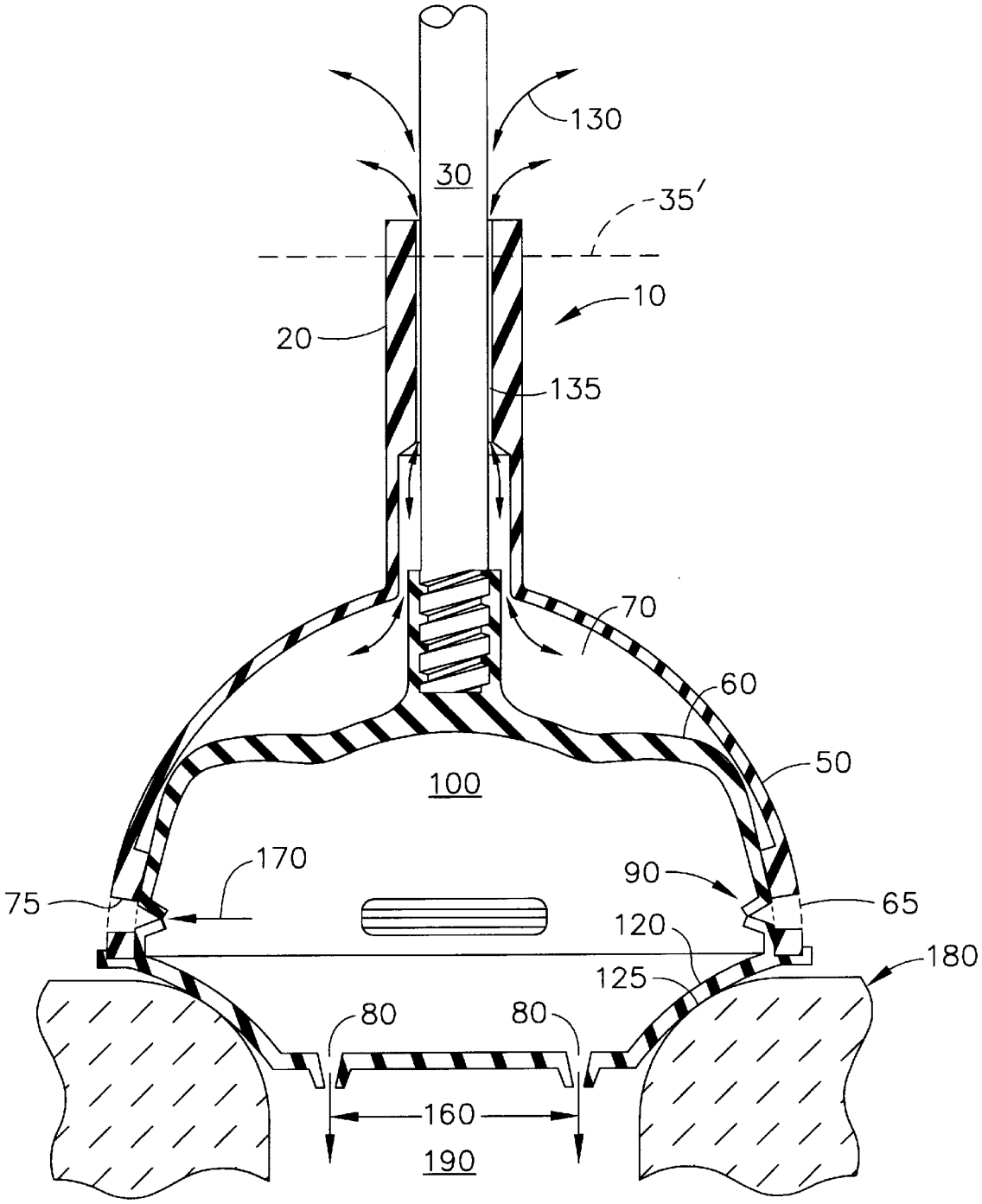
FIG. 5 illustrates a cross sectional view of the high pressure plunger of FIG. 4 engaged with a plumbing fixture and the first handle is partially depressed.

FIG. 5 is a cross sectional view of the liquid operated high pressure plunger 10 of FIG. 4 engaged with plumbing fixture 180 after inner cavity 100 has been purged of air and filled with liquid. Purging is accomplished by moving first handle 30 toward end member 120. As first cup 60 compresses, air pressure in inner cavity 100 is increased which maintains first check valve 90 in the closed position and opens second check valve 80 and air 130 is drawn into outer cavity 70 through handle space 135. Air in inner cavity 100 is forced out through second check valves 80. As first handle 30 is moved maximally toward end member 120, second check valve 80 closes when air in inner cavity 100 is depleted. While holding first handle 30 in the maximal position, high pressure plunger 10 is immersed in liquid then first handle 30 is retracted. Second check valves 80 remain closed and a low pressure is developed in inner cavity 100 which opens first check valves 90 and liquid flows into inner cavity 100 through screen 65 and external orifice 75. As first handle 30 is retracted from intermediate position 35', as shown in FIG. 4, to start position 35, first check valve 90 and second check valve 80 are closed and inner cavity 100 is substantially filled with liquid.

High pressure plunger 10 creates a seal 125 with plumbing fixture 180. Seal 125 is created and maintained by external force (not shown) applied through second handle 20 and second cup 50 toward plumbing fixture 180. End member 120 is structurally rigid with a resilient surface that conforms to any irregularities or roughness in the surface of plumbing fixture 180 when the external force is applied. After applying external force to second handle 20 with one hand, first handle 30 is moved from start position 35 shown in FIG. 4 to an intermediate position 35', as shown in FIG. 5, with a second hand. As first handle 30 is moved toward end member 120, first cup 60 is compressed and an increased pressure is exerted on the liquid (not depicted) in inner cavity 100. First check valves 90 remain closed as shown at 170 and second check valves 80 are opened as shown at 160. The liquid in inner cavity 100 is not compressible and any increased pressure therein is transferred to liquid backed up in plumbing fixture 180. The pressure in the liquid in inner cavity 100 is increased by direct movement of first handle 30 toward end member 120 and is limited by the integrity of seal 125 between end member 120 and plumbing fixture 180. It is incumbent on any operator to provide external force (not shown) simultaneously on both first handle 30 and second handle 20 toward plumbing fixture 180 to prevent the escape of liquid past seal 125.

One stroke of high pressure plunger 10 should supply sufficient hydraulic force to dislodge any obstruction (not shown) in plumbing fixture cavity 190. However, in the event that a second stroke is needed due to the escape of liquid past seal 125, the movement of said obstruction in plumbing fixture 180 without being dislodged or for any other reason, first handle 30 may be retracted as illustrated in FIG. 6, in preparation for one or more subsequent strokes.

Figure 6:
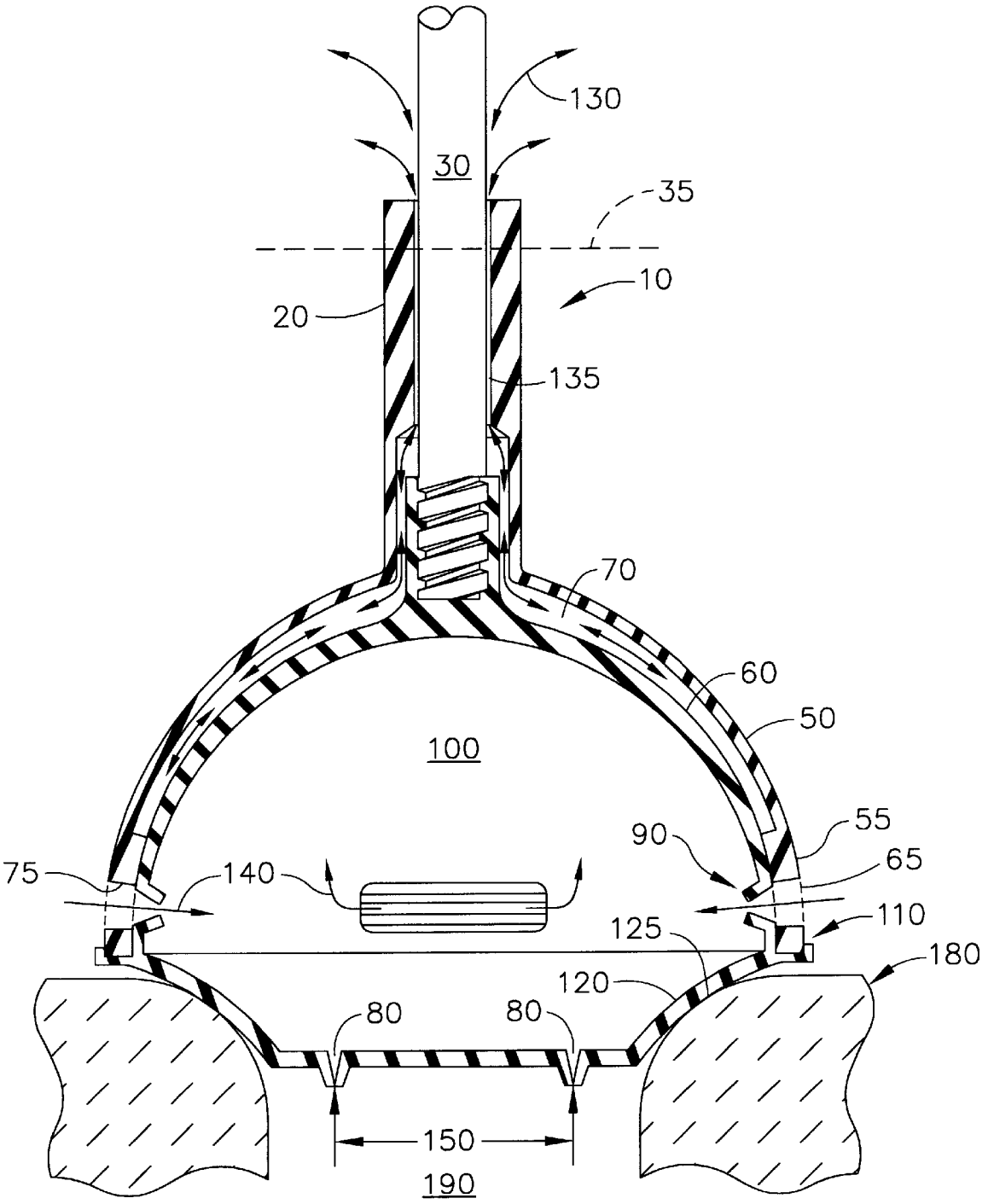
FIG. 6 illustrates a cross sectional view of the high pressure plunger of FIG. 4 engaged with a plumbing fixture and the first handle has been nearly retracted to the start position.

FIG. 6 is a cross sectional view of the liquid operated high pressure plunger 10 of FIG. 5 after first handle 30 is nearly retracted and in contemplation of a second or subsequent stroke which is identical in operation to the first stroke described above. Seal 125 is maintained by continued external force applied through second handle 20 and second cup 50 while first handle 30 is retracted.

As first handle 30 begins to retract, first cup 60 expands and the pressure in inner cavity 100 is decreased below that of plumbing fixture cavity 190 which closes second check valve 80 as shown at 150 and opens first check valve 90 as shown at 140. Pressure in outer cavity 70 is increased and air flow 130 exits outer cavity 70 through handle space 135. First handle 30 is farther retracted and liquid (not shown) is drawn into inner cavity 100 through external orifice 75. Liquid passes through screen 65 located on outside surface 55 of second cup 50 to filter out any solid material that may be present. When first handle 30 is returned to its start position 35, liquid flow stops and first check valve 90 and second check valve 80 are both closed as illustrated in FIG. 4.

The procedure of applying a second or subsequent stroke of first handle 30 would proceed as described herein for the first stroke and illustrated in FIG. 5 and FIG. 6. It is anticipated that multiple strokes of first handle 30 could be made while maintaining seal 125 with continuous external force on second handle 20 and second cup 50 and the effect of each subsequent stroke would be to further increase the pressure in plumbing fixture cavity 190 until said obstruction (not shown) is dislodged.

Figure 7:
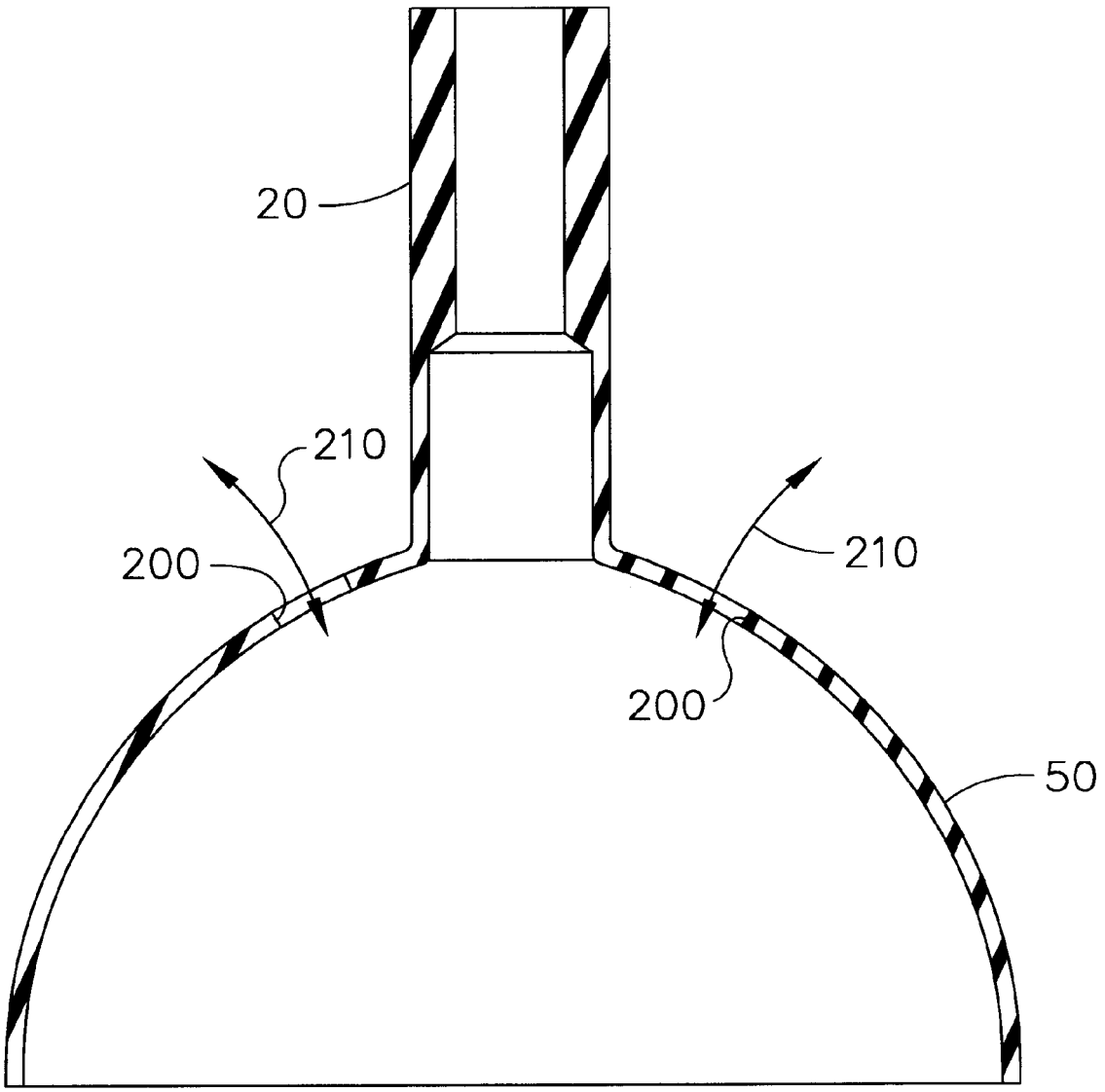
FIG. 7 illustrates a cross sectional view of an alternate embodiment of a second handle attached to a second cup that has a vent.

FIG. 7 illustrates an isolated cross sectional view of an alternate embodiment of second cup 50 attached to second handle 20 that further include vents 200. The alternate embodiment of second cup 50 has vents 200 that are in fluid communication with outer cavity 70 of FIG. 2. Air operated high pressure plunger 10 utilizes air 210 from outside outer cavity 70 which may be drawn in or forced out easily through vents 200.

Figure 8:
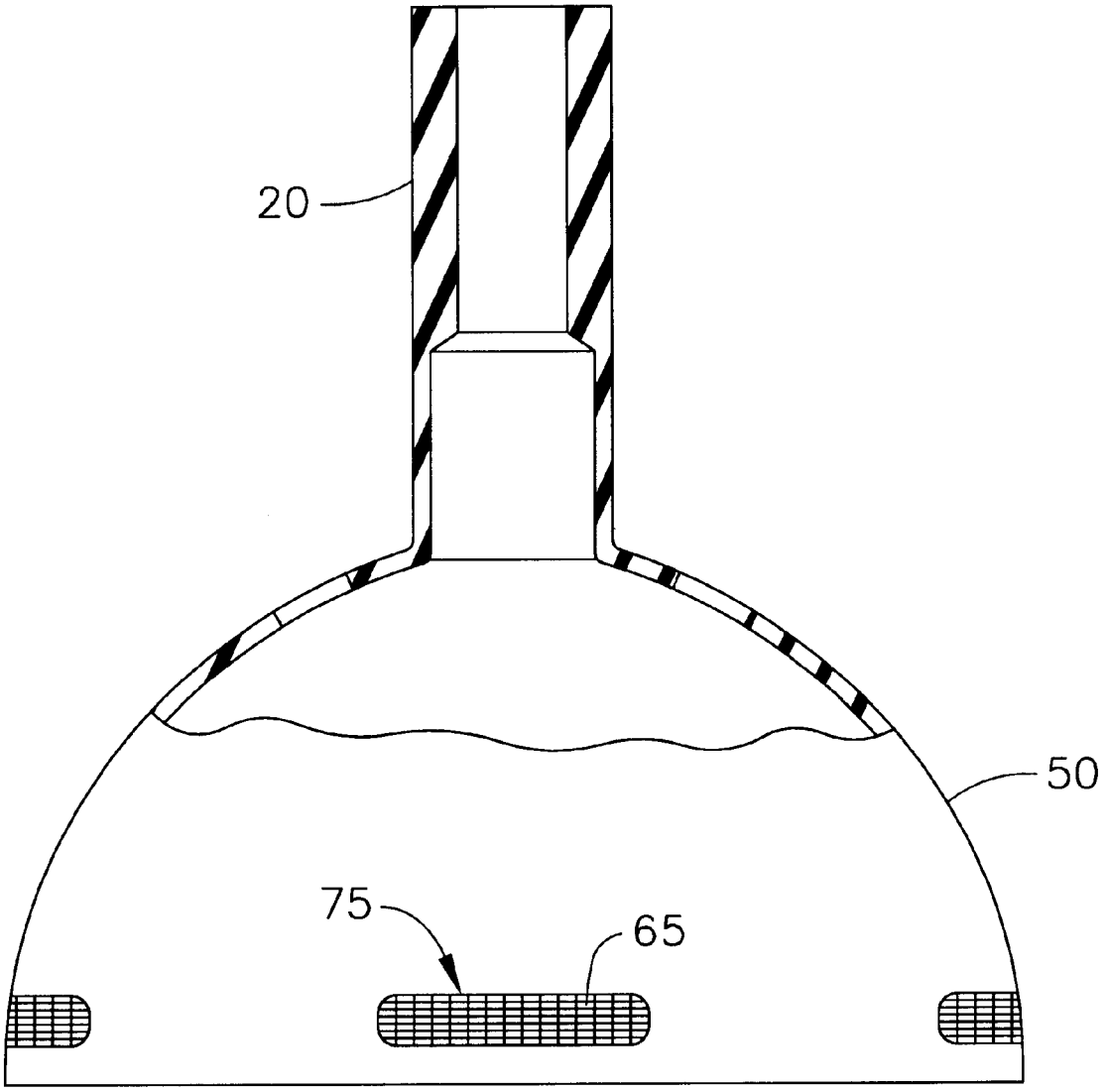
FIG. 8 illustrates a partial external view of a second cup attached to a second handle that illustrates the location of an external orifice covered by a screen.

FIG. 8 illustrates a partial external view of a second cup 50 attached to second handle 20 that indicates the location of an external orifice 75 covered by a screen 65. As described above and illustrated in FIGS. 5 and 6, external orifice 75 is in fluid communication with first check valve 90 which controls the flow of liquid into inner cavity 100 in the liquid operated high pressure plunger 10. Screen 65 covers external orifice 75 to filter out any solid material that may be undesirably drawn into inner cavity 100 and to prevent interference with the operation op valve 90.

The range of materials anticipated for the embodiments described herein are identical. First handle 30 comprises wood, fiberglass or other similarly ridged material. Second handle 20 and second cup 50 may be constructed as one piece or may be separate items connected together and either method would form a ridged structure and comprise any combination of fiber glass, hard rubber, aluminum or any similar water tolerant rigid material.

First cup 60 comprises a resiliently collapsible rubber material or any other elastomeric polymer that is strong and will collapse from external force yet regain its original shape when the external force is removed. End member 120 is contemplated to be of any one of several shapes that generally conform to the shape of the plumbing fixture in question and is comprised of ridged yet deformable rubber or of aluminum or fiber glass laminated with rubber to facilitate the formation of seal 125 with plumbing fixture 180. End member 120 requires the strength to support any external force applied through second handle 20 and second cup 50 without breaking or collapsing yet on its surface at seal 125 is capable of deforming enough to form liquid tight seal 125.

First check valve 90 and second check valve 80 are of conventional design and one or more types may be used in any embodiment of this invention. Shown in all Figures is a butterfly valve which can be molded directly into first cup 60 or end number 120. Each valve comprises a spring bias that holds it closed unless there is a pressure difference across the valve in the open direction. A pressure difference in the closed direction will act to close the valve further. The butterfly valve, as shown, will seal more tightly to prevent any reverse flow when a pressure differential is toward the closed direction. Other embodiments of a check valve could be utilized and are anticipated herein.

The present invention may be embodied in plungers of the type having a simple shape as illustrated or may be embodied in plungers of a more complex shape or design, including those with additional flexible parts.

Additional modifications and improvements of the present invention may also be apparent to those skilled in the art. Therefore, the particular combination of parts described and illustrated herein is intended to represent only two embodiments of the invention, and is not intended to serve as limitations of alternative plungers within the spirit and scope of the invention.

What I claim is:

1. A plunger comprising:

a compressible first cup having a first check valve configured to permit fluid flow into an inner cavity;

a rigid second cup that is larger than and concentric with said first cup;

a first handle connected to said first cup;

an end member held in sealing contact with an external fixture by force applied to a second handle and forming both said inner cavity with said first cup and an outer cavity with said second cup, said end member having a second check valve configured to permit fluid flow from said inner cavity to said external fixture;

said second handle connected to said second cup and coaxial with and slidably engaged by said first handle;

means for supplying air to said outer cavity.

2. A plunger according to claim 1 wherein said compressible first cup is compressed by moving said first handle from a starting position toward said end member.

3. A plunger according to claim 1, wherein said supplying means comprises an opening between said first handle and said second handle.

4. A plunger according to claim 1, wherein said fluid flow into said inner cavity comprises liquid from outside said second cup.

5. A plunger according to claim 1, wherein said first cup is comprised of rubber.

6. A plunger comprising:

an inner cavity formed by a compressible first cup and an end member wherein said first cup includes a first check valve and said end member includes a second check valve;

an outer cavity formed by a rigid second cup and said end member wherein said second cup is larger than and concentric with said first cup, and said first check valve is configured to permit fluid flow into said inner cavity, and said second check valve is configured to permit fluid flow from said inner cavity;

a first handle connected to said first cup;

a second handle connected to said second cup and coaxial with and slidably engaged by said first handle;

a vent that is in fluid communication with said outer cavity.

* * * * *